US012453879B2

(12) United States Patent
Dunbar et al.

(10) Patent No.: US 12,453,879 B2
(45) Date of Patent: Oct. 28, 2025

(54) WEIGHT SUPPORT ASSEMBLY FOR A WEIGHTLIFTING RACK

(71) Applicant: .50 Cal Fitness, LLC, Edna, TX (US)

(72) Inventors: Derek J. Dunbar, Edna, TX (US); Cody W. Engelmohr, Louise, TX (US)

(73) Assignee: .50 Cal Fitness, LLC, Edna, TX (US)

( * ) Notice: Subject to any disclaimer, the term of this patent is extended or adjusted under 35 U.S.C. 154(b) by 20 days.

(21) Appl. No.: 18/160,547

(22) Filed: Jan. 27, 2023

(65) Prior Publication Data

US 2023/0302321 A1 Sep. 28, 2023

Related U.S. Application Data

(60) Provisional application No. 63/324,074, filed on Mar. 26, 2022.

(51) Int. Cl.

| | |
|---|---|
| ***A63B 21/06*** | (2006.01) |
| ***A63B 21/00*** | (2006.01) |
| ***A63B 71/04*** | (2006.01) |

(52) U.S. Cl.

CPC ..... *A63B 21/0615* (2013.01); *A63B 21/4035* (2015.10); *A63B 71/04* (2013.01); *A63B 2208/0204* (2013.01)

(58) Field of Classification Search

CPC . A63B 21/0615; A63B 21/4035; A63B 71/04; A63B 2208/0204; A63B 17/02; A63B 21/00065; A63B 23/03541; A63B 23/1245; A63B 2225/09; A63B 21/078

See application file for complete search history.

(56) References Cited

U.S. PATENT DOCUMENTS

| | | | | |
|---|---|---|---|---|
| D892,239 | S | 8/2020 | Carmichael et al. | |
| 10,974,091 | B1 * | 4/2021 | Hensler | A63B 21/062 |
| 11,013,945 | B2 * | 5/2021 | Sorin | A63B 21/159 |
| 11,173,337 | B2 * | 11/2021 | Jones | A63B 21/0626 |
| 11,458,349 | B1 * | 10/2022 | Carlson | A63B 21/4035 |
| 11,896,867 | B1 * | 2/2024 | Nolan | A63B 21/4027 |
| 12,005,289 | B1 * | 6/2024 | Johnson | A63B 21/4035 |

* cited by examiner

*Primary Examiner* — Andrew M Kobylarz
(74) *Attorney, Agent, or Firm* — Harness, Dickey & Pierce, P.L.C.

(57) ABSTRACT

A weight support assembly for attachment to a lever arm pivotably connected to an exercise rack in a manner whereby weight can be positioned out in front of the rack for a more efficient work out is provided. The assembly is made of highly durable materials and can be readily attached and detached from the lever arm as needed.

15 Claims, 5 Drawing Sheets

WEIGHT SUPPORT ASSEMBLY FOR A WEIGHTLIFTING RACK

BACKGROUND

The present invention is directed to weightlifting and more particularly to a device for enhancing the efficiency of certain weightlifting activities.

SUMMARY

An offset weight support assembly for use in conjunction with a weight rack structure is disclosed. More particularly the offset weight support assembly is readily attachable to a pivot arm coupled to the weight rack. The subject device is designed such that weights positioned upon the offset weight assembly are disposed out in front of and away from the weight rack and generally above the handles. By positioning the weights in this manner, a more efficient work out can be accomplished in a shorter period of time than with currently known linear designs where weights are disposed in the same plane as the users hands opposite the handles. The subject device is extremely durable, easy to connect to the weight rack during use and easy to remove during periods of non-use.

Further areas of applicability will become apparent from the description provided herein. The description and specific examples in this summary are intended for purposes of illustration only and are not intended to limit the scope of the present disclosure.

BRIEF DESCRIPTION OF DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
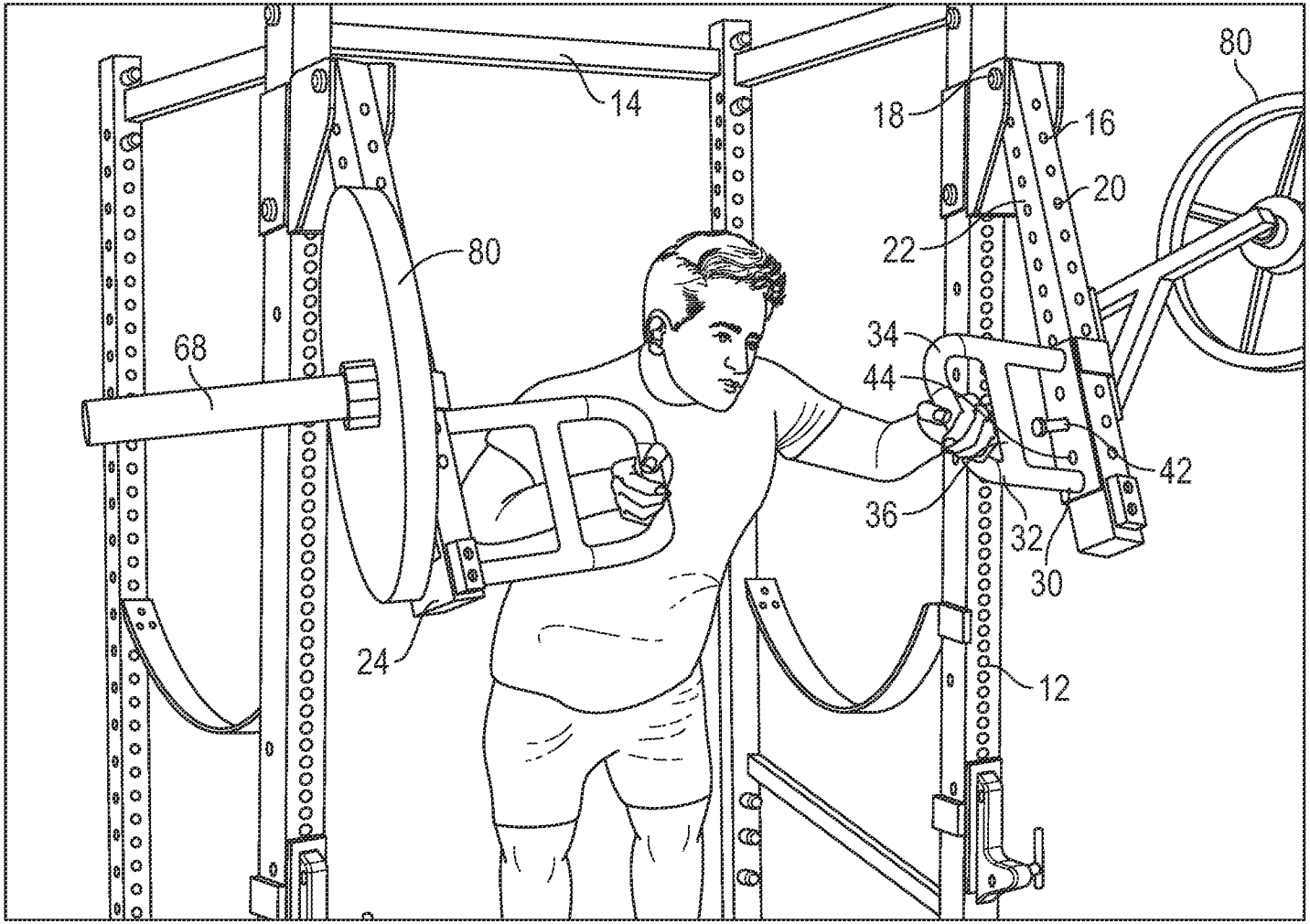
FIG. 1 is a perspective view of a left and right handed versions of first weight support assembly embodiment of the present invention attached to a weight rack.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

According to a first embodiment of the presentation invention the offset weight support assembly 30 of the present invention can be used with a variety of weight racks including a cage type weight rack 10 such as that shown in FIG. 1. The weight rack typically includes four or six spaced apart upright posts 12 and a plurality of horizontal crossbars 14 defining the rack. Coupled to the weigh rack 10 is one or more pivoting lever arms 16 generally positioned adjacent the post to which they are attached during periods of non-use and which are pivotable about a fulcrum point 18. The lever arms 16 include a plurality of apertures 20 for receiving fasteners associated with the offset weight support assembly 30. As should be understood by weightlifters, depending on the exercise being carried out a single lever arm or dual lever arms may be employed. Without limitation such exercises include these commonly known as standing chest presses, seated chest presses, standing rows and seated rows for example. As such, when dual lever arms are employed offset weight support assembly would be utilized on both of the lever arms. Likewise, it should be understood that left and right versions of each weight support assembly are mirror images. As such identical reference numbers will be used for identical components regardless of whether the left or right versions are being discussed.

The offset weight support assembly 30 generally includes a handle 32, a coupling 40 and a weight support structure 56. The assembly is typically formed from high strength steel or aluminum sufficient to withstand the load of weight applied to the assembly. The handle 32 is preferably in the form of a rounded or tubular loop 34 which can be easily grasped thus making it ergonomic. The loop may include a crossbar 36 to provide structural integrity. The ends of the loop are attached to a first fixture plate 38 which may have one or more holes 44 for receiving one or more fasteners 42. When attached to a first side wall 22 of a lever arm 16 at least one fastener 42, preferably in the form of a spring-loaded mounted pin is inserted through an aperture 18 thereof and a properly aligned hole 44 on the fixture plate 38 to assist in securing the weight support assembly. Extending from the first fixture plate 38 is a perpendicularly disposed second fixture plate 46 which is in turn integrally connected to a third fixture plate 48 to be positioned adjacent a second sidewall 24 of the same lever arm. Under this configuration the first and third fixture plates are mutually opposing.

Figure 2:
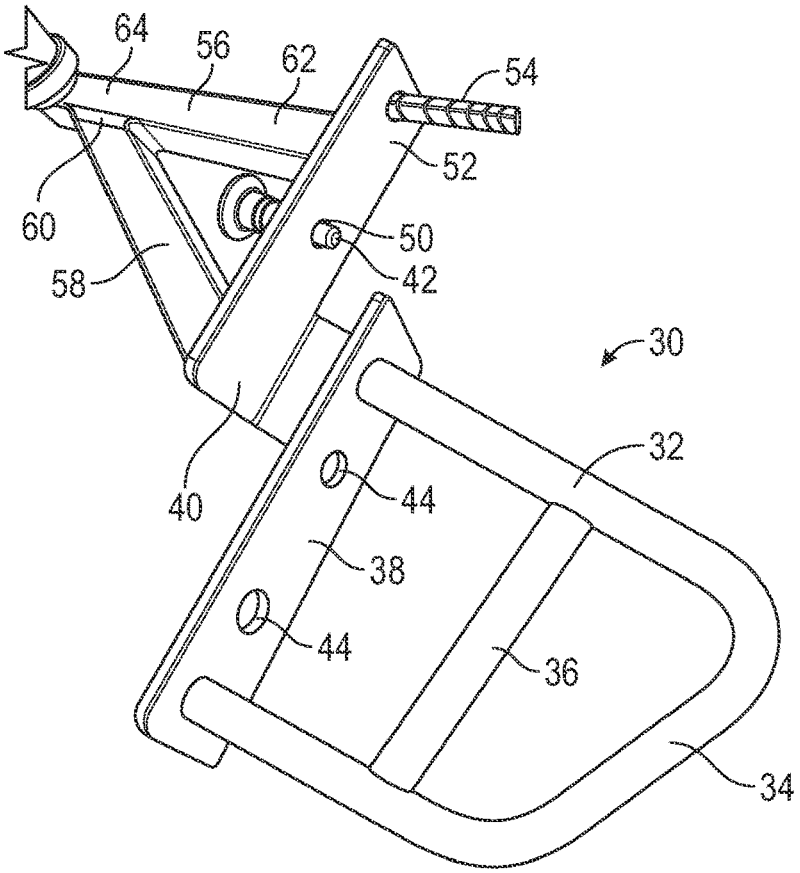
FIG. 2 is a partial side perspective view of a weight support assembly of FIG. 1.
Figure 3:
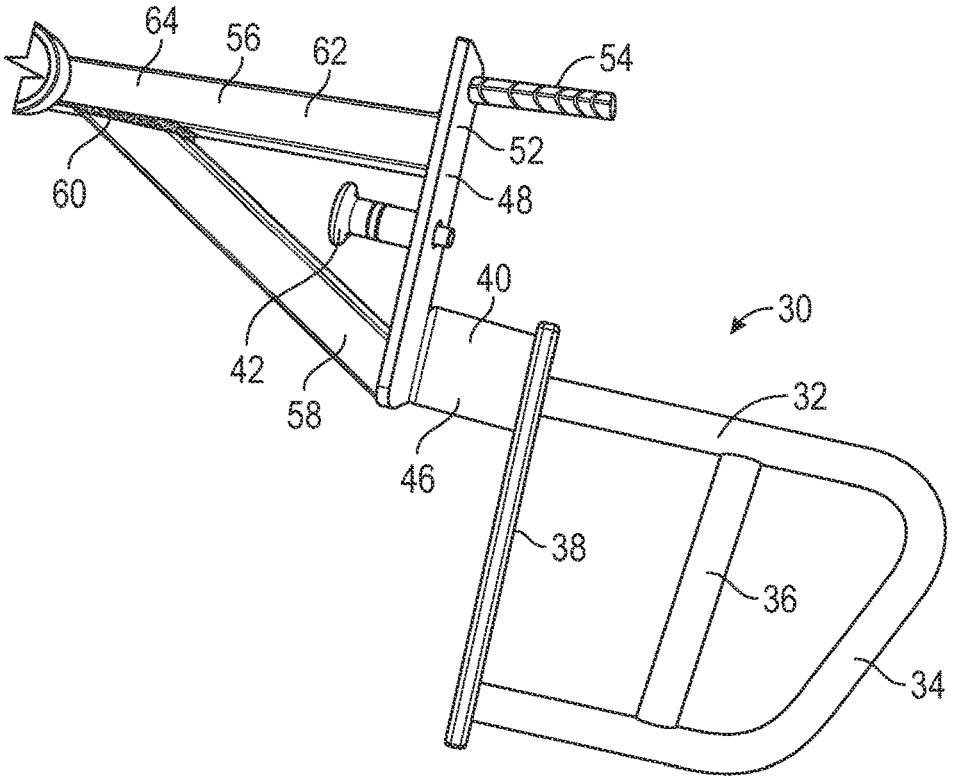
FIG. 3 is a rear perspective view of the weight support assembly of FIG. 1.
Figure 4B:
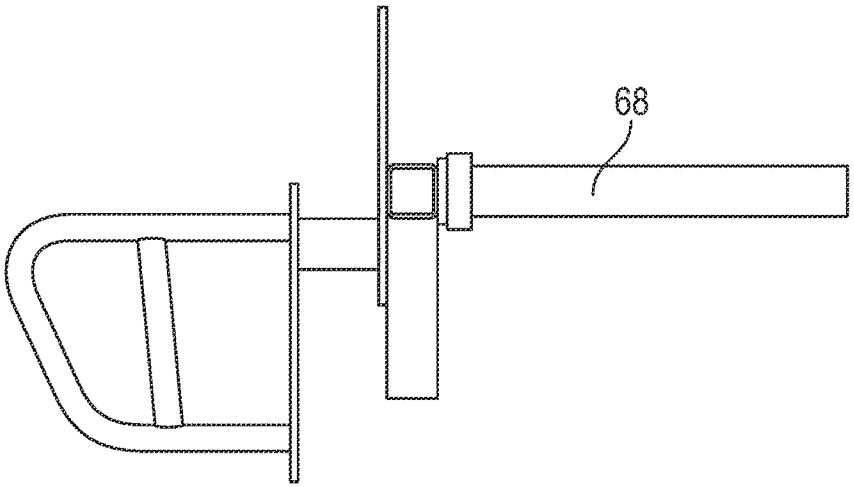
FIG. 4*a* and FIG. 4*b* are rear views of left and right versions of the weight support assembly of FIG. 1.
Figure 5B:
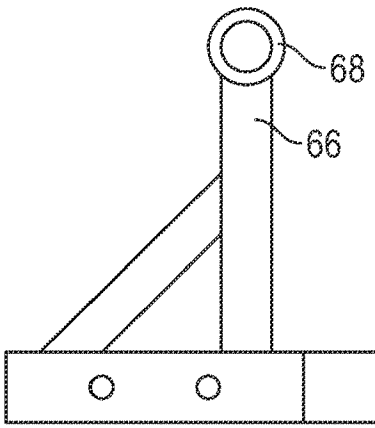
FIGS. 5*a* and 5*b* are end views of left and right versions of the weight support assembly of FIG. 1
Figure 4A:
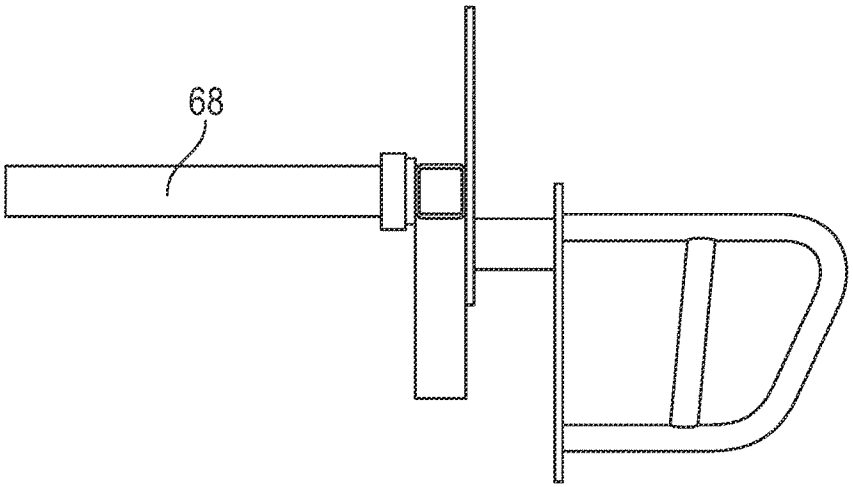
Figure 5A:
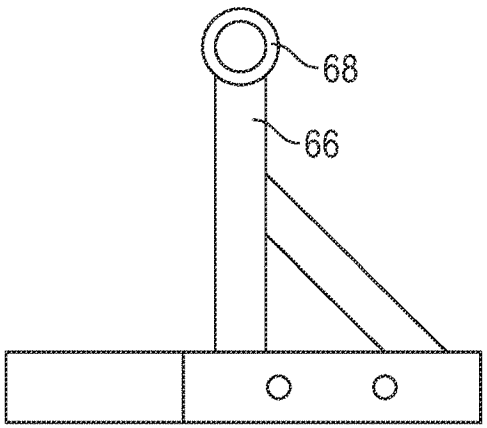
Figure 6:
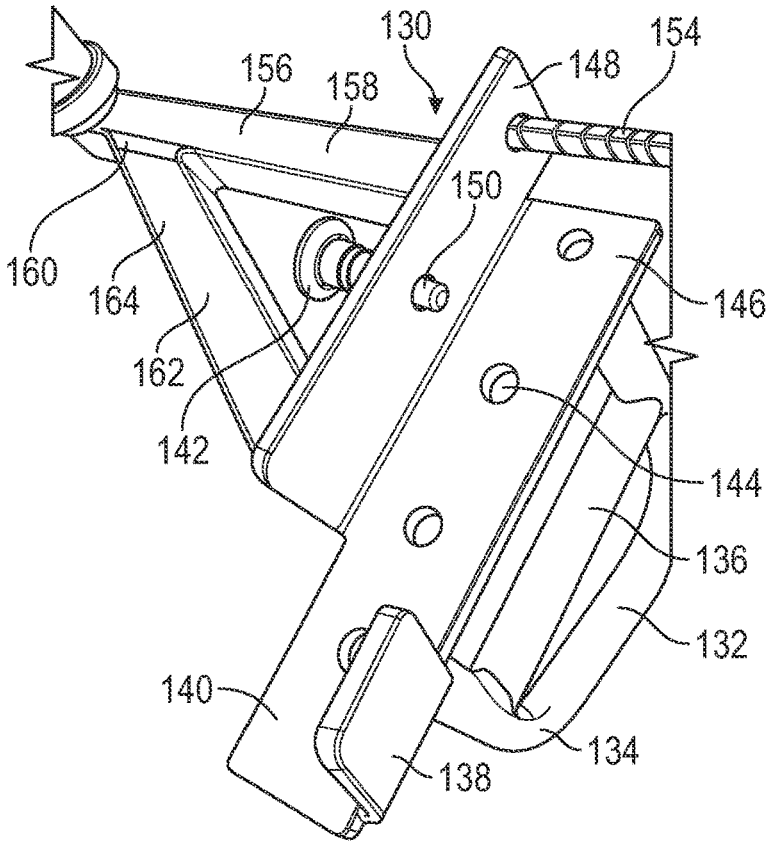
FIG. 6 is a partial side perspective view of a second weight support assembly embodiment of the presentation invention.
Figure 7:
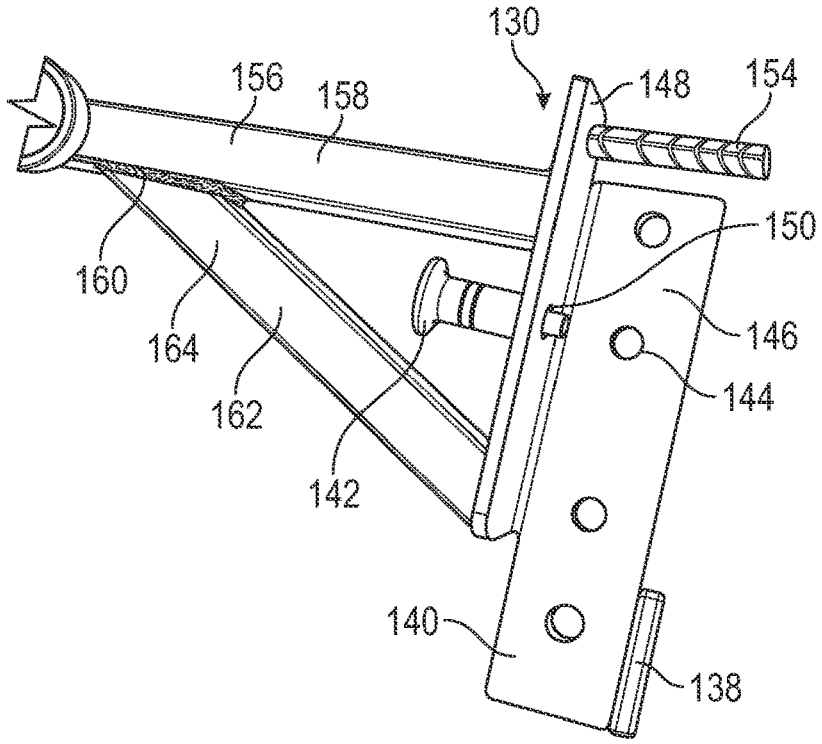
FIG. 7 is a rear perspective view of the weight support assembly of FIG. 6.
Figure 8B:
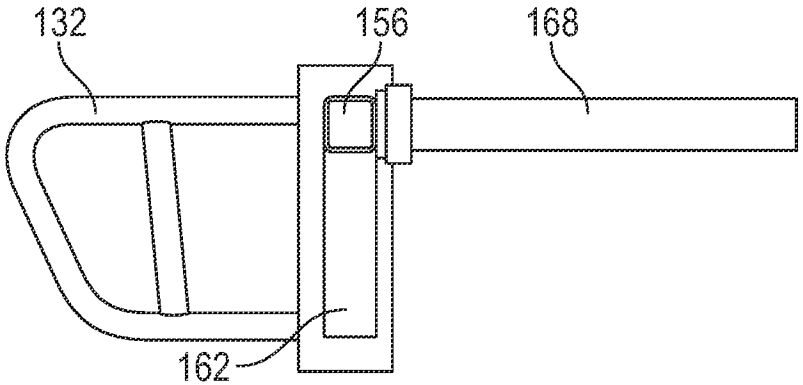
FIGS. 8*a* and 8*b* are rear views of left and right versions of the weight support assembly of FIG. 6.
Figure 8A:
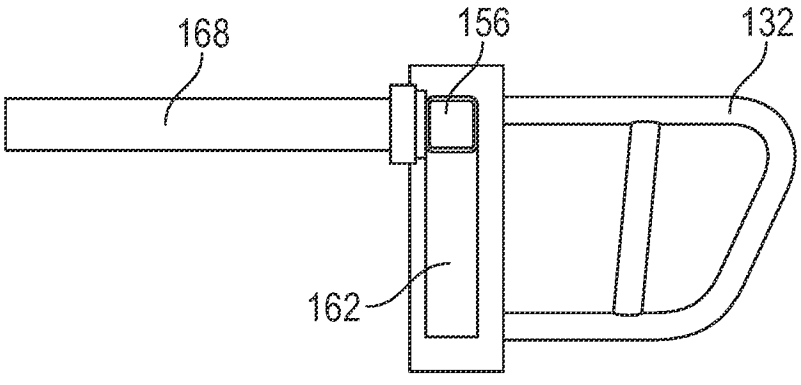
Figure 9B:
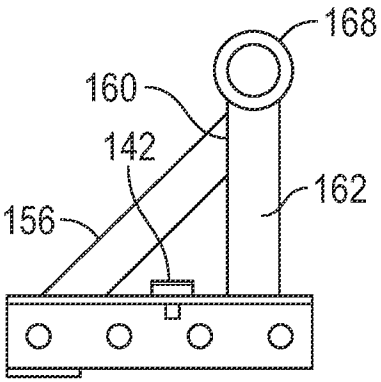
FIGS. 9*a* and 9*b* are end views of left and right versions of the weight support assembly of FIG. 6.
Figure 9A:
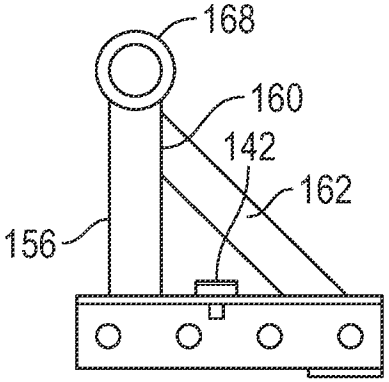

As shown most clearly in FIG. 2 and FIG. 3, the first fixture plate 38, the second fixture plate 46 and the third fixture plate 48 forms a coupling 40 otherwise referred to as a yoke that helps secure the assembly to the lever arm 16. The third fixture plate 48 also has one or more linearly aligned holes 50 as best shown in FIG. 2 through which fasteners 42 can be inserted. As also shown in FIG. 2 and FIG. 3, the first fixture plate 38 extends downwardly from the second fixture plate 46 and the third fixture plate 48 extends upwardly from the second fixture plate. Thus, the first and third fixture plates are offset. Optionally, but preferably, projecting from an inner wall 52 of the third fixture plate is a fixed post member 54 which is inserted through one of the apertures 18 of the pivoting lever arm 16. Once applied and properly fastened the coupling 40 seats directly against the lever arm.

The weight support structure 56 includes a first leg 58 extending upwardly and at an angle from an outer wall of the third fixture plate 48 and a second leg 62 which extends perpendicularly from the outer wall of the third fixture plate. The second leg intersects with a terminal end 60 of the first leg and extends beyond the intersection point. In the embodiment shown in FIGS. 2 and 3, for example, the combination of the third fixture plate and the first and second legs form a substantially triangular shaped brace 64 which also assists in distributing the weight load. A portion 66 of the second leg 62 extends beyond the intersection and includes an outwardly extending bar 68 for receiving one or more free weights. The bar projects in the direction opposite the handle 32.

According to this design once the free weight is applied to the weight bar 68, one or more weights 80 as shown in FIG. 1 are positioned upward from the handle and away from the lever arm. In this position a person utilizing the offset weight support assembly can more quickly feel the pressure of the weight during a workout. By way of comparison when using a traditional linear weight support assembly where the weights are directly in line with the lever arms, the lever arms must be rotated approximately 25 to 30%, e.g., the appropriate starting point under the invention, before the user experiences substantial pressure on their arms and upper body muscles.

Turning now to FIGS. 6-9*b* a second embodiment of the offset weight support assembly 130 of the present invention includes a handle 132, a coupling 140 and a weight support structure 156. This embodiment is also preferably formed from high strength steel and/or aluminum for example. The handle 132 may be of a loop design 134 with one or more crossbars 136. The ends of the loop are attached to centrally disposed second fixture plate 146. The fixture plate 146 may include one or more holes 144 for receiving fasteners 142 such as spring-loaded push pins by way of non-limited example if desired.

Extending substantially perpendicularly along the lower portion of a first edge of the plate 146 is a first fixture plate 138. Extending substantially perpendicularly along the upper portion of a second edge of a plate 146 is a third fixture plate 148. The third fixture plate 148 may include one or more holes 150 for hosting a fastener 142 to assist in coupling the weight support assembly to the rotating pivot arm. The fastener 142 may be a spring-loaded push pin which locks in place once fully inserted through one of the holes 150. Extending inwardly from the third fixture plate 148 proximate a first end thereof is a fixed post member 154 which projects into and through one of the holes disposed on the pivot arm to help robustly secure the weight support assembly 130 to a weight rack 10 as shown in FIG. 1. The combination of plates 138, 146 and 148 form a yoke.

Projecting outwardly from an opposite side of the coupling plate 146 is the weight support structure 156. As with the first embodiment 30 the weight support structure includes a first leg 158 and second leg 162 adjoined at 160 to form a triangular base 164 in conjunction with the plate 148. A portion 166 of the second leg 162 extends beyond the intersection 160 and includes an outwardly extending bar 168 for receiving one or more free weights 80. As should be appreciated the second embodiment can be utilized in the same manner of the first embodiment.

While not shown, under certain embodiments the handle of the offset weight support assembly may be inwardly foldable to provide better access to the interior of the weigh rack. Under the foldable embodiment the handle may also be spring-loaded such that the handle is rotatably folded and is only extended during use. Further, while the weight bars are shown as being welded to the second leg, it should be noted that the weight bars can be bolted or otherwise fastened to the second leg for ease in shipping.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An offset weight support assembly for attachment to a pivoting lever arm of a weight rack comprising:

a coupling connected to the pivoting lever arm, said coupling including at least one fastener for securing the weight support assembly to the pivoting lever arm;

at least one fastener for securing the coupling to the pivoting lever arm;

a handle extending inwardly from the coupling; and a weight support structure including a brace and a weight bar extending outwardly and away from the coupling for receiving one or more weights;

whereby upon attaching the weight support assembly to the pivoting lever arm and positioning one or more weights to said weight support structure, the one or more weights are substantially offset in front of the pivoting lever arm.

2. The offset weight support assembly of claim 1, wherein the coupling includes a first fixture plate, a second fixture plate, and third fixture plate forming a yoke.

3. The offset weight support assembly of claim 2, wherein the first fixture plate and the third fixture plate are mutually opposing.

4. The offset weight support assembly of claim 2, wherein one of said fixture plates includes an inwardly extending fixed post member which projects through a hole occurring along said pivoting lever arm.

5. The offset weight support assembly of claim 4, wherein the fixed post member projects proximate a first end of said third fixture plate.

6. The offset weight support assembly of claim 1, wherein said handle is in the form of a tubular loop.

7. The offset weight support assembly of claim 1, wherein said brace includes an upwardly angled first leg extending from a fixture plate and a horizontally disposed second leg extending from the same fixture plate.

8. The offset weight support assembly of claim 1, wherein the at least one fastener is a spring-loaded pin.

9. The offset weight support assembly of claim 1, wherein the weight bar extends substantively perpendicularly from said brace.

10. An offset weight support assembly for use in association with a weight rack including a pivoting lever arm comprising:

a coupling connectable to the pivoting lever arm including a first fixture plate, a second fixture plate extending from said first fixture plate and a third fixture plate extending from said second fixture plate collectively forming a yoke positioned along said lever arm and at least one of said fixture plates include at least one selectively releasable fastener for securing the weight support assembly to the pivoting lever arm;

an ergonomic handle extending from said first fixture plate toward the interior of said weight rack; and a weight support structure including a brace extending outwardly and away from said coupling along one end and having a weight bar disposed along a second end, said weight bar projecting away from the interior of the weight rack;

whereby upon attaching one or more weights to said weight bar, the one or more weights are substantially offset out in front of the lever arm.

11. The offset weight support assembly of claim 10, wherein one of said fixture plates includes an inwardly extending fixed post member which projects through a hole occurring along said pivoting lever arm.

12. The offset weight support assembly of claim 11, wherein the fixed post member projects proximate a first end of said third fixture plate.

13. The offset weight support assembly of claim 10, wherein said ergonomic handle is in the form of a tubular loop.

14. The offset weight support assembly of claim 10, wherein said brace includes an upwardly angled first leg extending from a said third fixture plate and a horizontally disposed second leg extending from said third fixture plate.

15. The offset weight support assembly of claim 10, wherein the at least one selectively releasable fastener is a spring-loaded pin.

* * * * *